US010037729B2

(12) United States Patent
Park et al.

(10) Patent No.: US 10,037,729 B2
(45) Date of Patent: Jul. 31, 2018

(54) DISPLAY DEVICE INCLUDING HOST AND PANEL DRIVING CIRCUIT THAT COMMUNICATE WITH EACH OTHER USING CLOCK-EMBEDDED HOST INTERFACE AND METHOD OF OPERATING THE DISPLAY DEVICE

(71) Applicant: Samsung Electronics Co., Ltd., Suwon-si, Gyeonggi-do (KR)

(72) Inventors: Hyun-Sang Park, Seongnam-si (KR); Soo-Jung Nam, Suwon-si (KR); Kyeonghwan Kwon, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 90 days.

(21) Appl. No.: 14/850,296

(22) Filed: Sep. 10, 2015

(65) Prior Publication Data

US 2016/0125794 A1 May 5, 2016

(30) Foreign Application Priority Data

Oct. 30, 2014 (KR) ..... 10-2014-0149341

(51) Int. Cl.
*G09G 3/20* (2006.01)

(52) U.S. Cl.
CPC ..... *G09G 3/2096* (2013.01); *G09G 2370/08* (2013.01)

(58) Field of Classification Search
None
See application file for complete search history.

(56) References Cited

U.S. PATENT DOCUMENTS

| | | | | |
|---|---|---|---|---|
| 8,314,763 | B2 | 11/2012 | Park et al. | |
| 2003/0197706 | A1* | 10/2003 | Isozaki | G09G 3/3611 345/535 |
| 2008/0246752 | A1 | 10/2008 | Lee | |
| 2009/0245345 | A1 | 10/2009 | Lee et al. | |
| 2009/0284509 | A1 | 11/2009 | Choe | |
| 2011/0242066 | A1 | 10/2011 | Jeon et al. | |
| 2012/0327047 | A1* | 12/2012 | Jin | H04N 5/00 345/204 |
| 2014/0118623 | A1* | 5/2014 | Bushell | G09G 3/3666 348/705 |
| 2015/0091948 | A1* | 4/2015 | Kwa | G09G 5/18 345/690 |
| 2015/0199292 | A1* | 7/2015 | Lum | G06F 13/4221 710/315 |

OTHER PUBLICATIONS

Wiki ("DisplayPort", Sep. 2014, "http://en.wikipedia.org/wiki/DisplayPort").*
Wiley ("DisplayPort Technical Overview", 2011, IEEE).*

* cited by examiner

*Primary Examiner* — Xin Sheng
(74) *Attorney, Agent, or Firm* — Harness, Dickey & Pierce, P.L.C.

(57) ABSTRACT

A display device communicates using a clock-embedded host interface. The display device includes a panel driving circuit and a host. The panel driving circuit includes at least one timing controller embedded driver (TED), and drives a display panel. The host at least one of transmits and receives video data, additional data, and a hot plug detect (HPD) signal to or from the at least one TED through one port using a clock-embedded host interface.

19 Claims, 19 Drawing Sheets

| Aux Addres | TED Selection | Comments |
|---|---|---|
| 0X | TED0/TED1 | Broadcasting for Write Transaction |
| 10 | TED0 | Write/Read Transaction |
| 11 | TED1 | Write/Read Transaction |

| | | | | | | |
|---|---|---|---|---|---|---|
| TX | SYNC | COMM3:0 | ADDR19:0 | LEN7:0 | DATA(byte unit) | Stop |
| TED0 | SYNC | COMM3:0 | ADDR19:0 | LEN7:0 | DATA(byte unit) | Stop |
| TED1 | SYNC | COMM3:0 | ADDR19:0 | LEN7:0 | DATA(byte unit) | Stop |

(READ COMMAND TRANSMISSION)

FIG. 12

| Aux Addres | TED Selection | Comments |
|---|---|---|
| 0XX | TED0/TED1/ TED2/TED3 | Broadcasting for Write Transaction |
| 100 | TED0 | Write/Read Transaction |
| 101 | TED1 | Write/Read Transaction |
| 110 | TED2 | Write/Read Transaction |
| 111 | TED3 | Write/Read Transaction |

DISPLAY DEVICE INCLUDING HOST AND PANEL DRIVING CIRCUIT THAT COMMUNICATE WITH EACH OTHER USING CLOCK-EMBEDDED HOST INTERFACE AND METHOD OF OPERATING THE DISPLAY DEVICE

CROSS-REFERENCE TO RELATED APPLICATION

This application claims priority under 35 U.S.C. § 119 to Korean Patent Application No. 10-2014-0149341 filed on Oct. 30, 2014, the disclosure of which is hereby incorporated by reference in its entirety.

BACKGROUND

Field

At least one example embodiment of inventive concepts relates to a display device, and more particularly, to a display device including a panel driving circuit in which a timing controller is included.

Description of Related Art

Recently, as mobile terminal screens have become larger and the number of channels has increased, more than two driving chips are desired to drive a display panel. In a mobile terminal, because power consumption has a direct influence on sales of a product, reduction in power consumption is desired.

An interface between a host and a panel driving circuit is one area in which reduction of power consumption in a mobile terminal is possible.

SUMMARY

At least one example embodiment of inventive concepts provides a display device having a simple system structure that is capable of reducing power consumption.

At least one example embodiment of inventive concepts also provides a method of operating a display device having a simple system structure that is capable of reducing power consumption.

Inventive concepts are not limited to example embodiments described herein, and other implementations may become apparent to those of ordinary skill in the art based on the following descriptions.

According to at least one example embodiment, a display device includes a panel driving circuit including at least one timing controller embedded driver (TED). The panel driving circuit is configured to drive a display panel. The display device includes a host configured to at least one of transmit and receive video data, additional data, and a hot plug detection (HPD) signal to or from the at least one TED through one port using a clock-embedded host interface.

According to at least one example embodiment, the host is configured to transmit the video data to the at least one TED through a main link, the at least one TED includes a plurality of TEDs. The main link includes a plurality of lanes associated with the plurality of TEDs, and the host is configured to transmit the video data through the plurality of lanes such that each of the plurality of TEDs drives a different portion of the display panel.

According to at least one example embodiment, the at least one TED is configured to receive the video data from the host, to at least one of transmit and receive the additional data to or from the host, to transmit the HPD signal to the host, and to at least one of transmit and receive the HPD signal to or from the others of the at least one TED.

According to at least one example embodiment, the host is configured to transmit the video data to the at least one TED through a main link that includes a plurality of lanes, to at least one of transmit and receive the additional data to or from the at least one TED through an auxiliary bus, and to receive the HPD signal from the at least one TED through an HPD bus.

According to at least one example embodiment, the plurality of lanes includes a first lane, a second lane, a third lane, and a fourth lane, and the at least one TED includes a first TED and a second TED. The first TED is configured to receive the video data through the first lane and the second lane, and to drive an area of a first half of the display panel. The second TED is configured to receive the video data through the third lane and the fourth lane, and to drive an area of a second half of the display panel.

According to at least one example embodiment, each of the first TED and the second TED is configured to at least one of transmit and receive the additional data to or from the host through the auxiliary bus, and to transmit the HPD signal to the host through the HPD bus.

According to at least one example embodiment, the first TED and the second TED are configured to at least one of transmit and receive the HPD signal to or from each other through the HPD bus.

According to at least one example embodiment, the host is configured to select the at least one TED in response to an address transmitted through the auxiliary bus for a write operation or a read operation.

According to at least one example embodiment, the at least one TED includes a first TED and a second TED, and the host is configured to select the first TED if the address transmitted through the auxiliary bus is "10," and select the second TED if the address transmitted through the auxiliary bus is "11."

According to at least one example embodiment, the at least one TED includes a first TED and a second TED and, if the address transmitted through the auxiliary bus is "00" or "01," the host is configured to select both of the first TED and the second TED, and the write operation or the read operation is not performed but broadcasting of the write operation is performed.

According to at least one example embodiment, the auxiliary bus is connected in a multi-drop structure among the host and the at least one TED.

According to at least one example embodiment, a display device includes a panel driving circuit including at least one timing controller embedded driver (TED). The panel driving circuit is configured to drive a display panel. The display device includes an application processor (AP) configured to at least one of transmit and receive video data, additional data, and a hot plug detection (HPD) signal to or from the at least one TED using a clock-embedded host interface.

According to at least one example embodiment, the AP is configured to transmit the video data to the at least one TED through a main link that includes a plurality of lanes, to at least one of transmit and receive the additional data to or from the at least one TED through an auxiliary bus, and to receive the HPD signal from the at least one TED through an HPD bus.

According to at least one example embodiment, the plurality of lanes includes a first lane, a second lane, a third lane, and a fourth lane, and the at least one TED includes a first TED, a second TED, a third TED, and a fourth TED. The first TED is configured to receive the video data through the first lane, and to drive an area of a first quarter of the display panel. The second TED is configured to receive the video data through the second lane, and to drive an area of a second quarter of the display panel. The third TED is configured to receive the video data through the third lane, and to drive an area of a third quarter of the display panel. The fourth TED is configured to receive the video data through the fourth lane, and to drive an area of a fourth quarter of the display panel.

According to at least one example embodiment, each of the first TED, the second TED, the third TED and the fourth TED is configured to at least one of transmit and receive the additional data to or from the host through the auxiliary bus, and to transmit the HPD signal to the AP through the HPD bus.

According to at least one example embodiment, a display device a host configured to at least one of send and receive video data, additional data, and a hot plug detection (HPD) signal to or from at least one timing controller embedded driver (TED) through a single port using a clock-embedded host interface. The at least one TED is configured to drive a display panel of the display device.

According to at least one example embodiment, the host is configured to send the video data to the at least one TED through a main link.

According to at least one example embodiment, the at least one TED includes a plurality of TEDs, and the main link includes a plurality of lanes associated with the plurality of TEDs. The host is configured to send the video data through the plurality of lanes such that each of the plurality of TEDs drives a different portion of the display panel.

According to at least one example embodiment, the host is configured to at least one of send and receive the additional data through a first bus.

According to at least one example embodiment, the host is configured to at least one of send and receive the HPD signal through a second bus.

BRIEF DESCRIPTION OF THE DRAWINGS

The foregoing and other features and advantages of the inventive concept will be apparent from the more particular description of preferred embodiments of the inventive concept, as illustrated in the accompanying drawings in which like reference characters refer to the same parts throughout the different views. The drawings are not necessarily to scale, emphasis instead being placed upon illustrating the principles of the inventive concept. In the drawings:

FIG. 12 is a table illustrating a method for selecting TEDs using addresses transmitted through the auxiliary bus in an auxiliary read mode or in an auxiliary write mode in the display device of FIG. 11;

DETAILED DESCRIPTION OF EXAMPLE EMBODIMENTS

Figure 1:
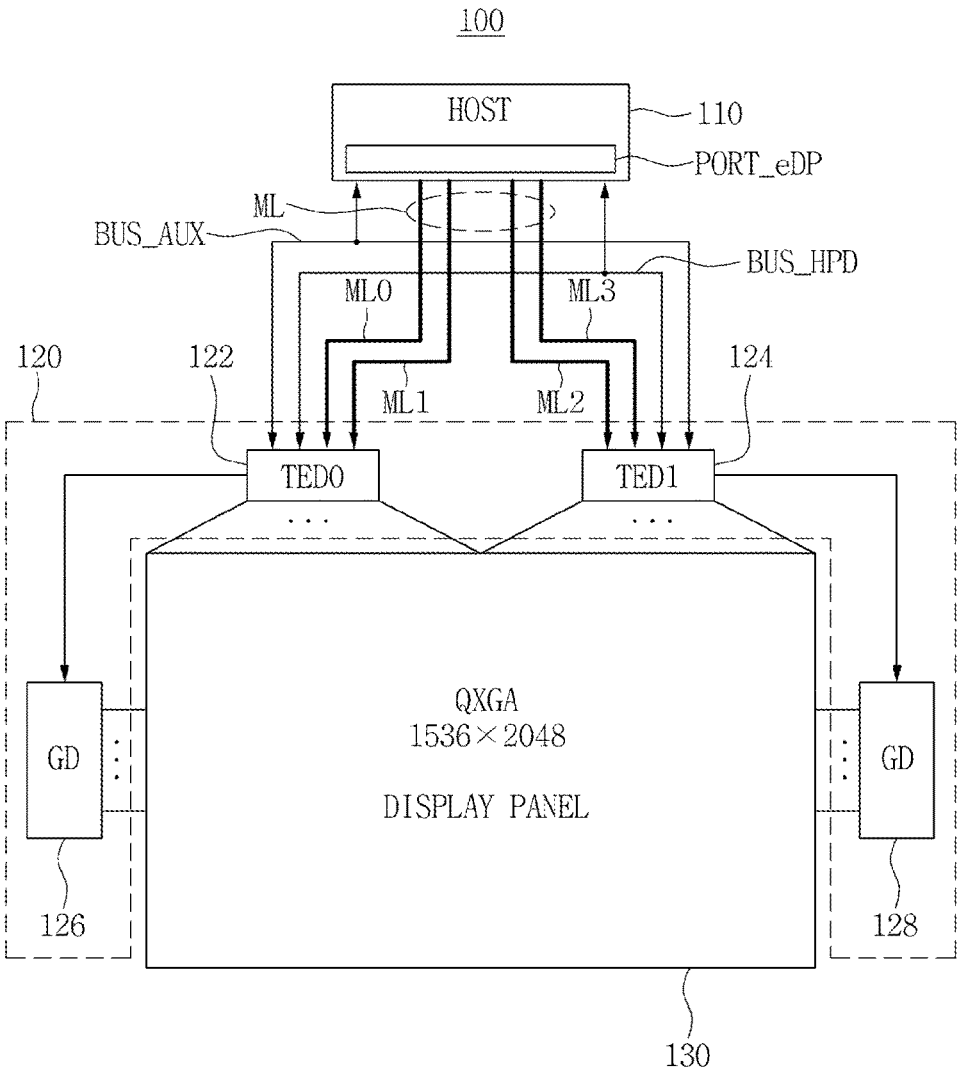
FIG. 1 is a block diagram illustrating a display device in accordance with at least one example embodiment of inventive concepts.

Inventive concepts will now be described more fully with reference to the accompanying drawings, in which example embodiments of are shown. These example embodiments are provided so that this disclosure will be thorough and complete, and will fully convey inventive concepts of to those skilled in the art. Inventive concepts may be embodied in many different forms with a variety of modifications, and a few embodiments will be illustrated in drawings and explained in detail. However, this should not be construed as being limited to example embodiments set forth herein, and rather, it should be understood that changes may be made in these example embodiments without departing from the principles and spirit of inventive concepts, the scope of which are defined in the claims and their equivalents. Like numbers refer to like elements throughout. In the drawings, the thicknesses of layers and regions are exaggerated for clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Specific details are provided in the following description to provide a thorough understanding of example embodiments. However, it will be understood by one of ordinary skill in the art that example embodiments may be practiced without these specific details. For example, systems may be shown in block diagrams so as not to obscure example embodiments in unnecessary detail. In other instances, well-known processes, structures and techniques may be shown without unnecessary detail in order to avoid obscuring example embodiments.

In the following description, illustrative embodiments will be described with reference to acts and symbolic representations of operations (e.g., in the form of flow charts, flow diagrams, data flow diagrams, structure diagrams, block diagrams, etc.) that may be implemented as program modules or functional processes include routines, programs, objects, components, data structures, etc., that perform particular tasks or implement particular abstract data types and may be implemented using existing hardware in existing electronic systems (e.g., electronic imaging systems, image processing systems, digital point-and-shoot cameras, personal digital assistants (PDAs), smartphones, tablet personal computers (PCs), laptop computers, etc.). Such existing hardware may include one or more Central Processing Units (CPUs), digital signal processors (DSPs), application-specific-integrated-circuits (ASICs), field programmable gate arrays (FPGAs) computers or the like.

Although a flow chart may describe the operations as a sequential process, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

As disclosed herein, the term "storage medium", "computer readable storage medium" or "non-transitory computer readable storage medium" may represent one or more devices for storing data, including read only memory (ROM), random access memory (RAM), magnetic RAM, core memory, magnetic disk storage mediums, optical storage mediums, flash memory devices and/or other tangible or non-transitory machine readable mediums for storing information. The term "computer-readable medium" may include, but is not limited to, portable or fixed storage devices, optical storage devices, and various other tangible or non-transitory mediums capable of storing, containing or carrying instruction(s) and/or data.

Furthermore, example embodiments may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a computer readable storage medium. When implemented in software, a processor or processors may be programmed to perform the necessary tasks, thereby being transformed into special purpose processor(s) or computer(s).

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "includes", "including", "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which inventive concepts belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Expressions such as "at least one of," when preceding a list of elements, modify the entire list of elements and do not modify the individual elements of the list.

FIG. 1 is a block diagram illustrating a display device 100 according to at least one example embodiment of the inventive concepts.

Referring to FIG. 1, the display device 100 may include a host 110, a panel driving circuit 120 and a display panel 130.

The panel driving circuit 120 includes timing controller embedded drivers (TEDs) TED0 (122) and TED1 (124), and drives the display panel 130. The TEDs may include a timing controller configured to drive the display panel 130. The panel driving circuit 120 may further include gate drivers 126 and 128 that control the display panel 130 in response to control signals including a gate-start pulse. The host 110 transmits (or sends) or receives video data, additional data, and a hot plug detect (or detection) (HPD) signal to or from the TEDs TED0 and TED1 through one port (a single port) PORT_eDP using a clock-embedded host interface. The HPD signal may be a signal that indicates a connection of the host 110 to the display panel 130 in order to initiate a communication sequence between the host 110 and the TEDs. The clock-embedded host interface may be an interface capable of sending and receiving clock signals that are embedded in data signals (e.g., the clock-embedded host interface is capable of sending and receiving a clock signal and a data signal as a single encoded signal). The host 110 may be a system-on-chip (SOC).

The host 110 may transmit the video data to the TEDs TED0 and TED1 through a port PORT_eDP, transmit or receive the additional data to or from the TEDs TED0 and TED1 through the port PORT_eDP, and receive the HPD signal from the TEDs TED0 and TED1 through the port PORT_eDP. Each of the TEDs TED0 and TED1 may receive the video data from the host 110, transmit or receive the additional data to or from the host 110, transmit the HPD signal to the host 110, and transmit or receive the HPD signal to or from the others of the TEDs TED0 and TED1.

The host 110 may transmit the video data to the TEDs TED0 and TED1 through a main link ML that includes a plurality of lanes ML0, ML1, ML2 and ML3, transmit or receive the additional data to or from the TEDs TED0 and TED1 through an auxiliary bus BUS_AUX, and receive the HPD signal from the TEDs TED0 and TED1 through an HPD bus BUS_HPD.

The panel driving circuit 120 may include a first TED TED0 and a second TED TED1. The first TED TED0 receives the video data through a first lane ML0 and a second lane ML1 of the main link ML, and drives an area of a first half of the display panel 130. The second TED TED1 receives the video data through a third lane ML2 and a fourth lane ML3 of the main link ML, and drives an area of a second half of the display panel 130. In other words, if at least one TED includes a plurality of TEDs (e.g., TED0 and TED1), it may be said that the main link ML includes a plurality of lanes (e.g., ML1 to ML4) associated with the plurality of TEDs (e.g., TED0 and TED1), and that the host is configured to send the video data through the plurality of lanes (e.g., ML1 to ML4) such that each of the plurality of TEDs (e.g., TED0 and TED1) drives a different portion of the display panel 130.

Each of the first TED TED0 and the second TED TED1 may transmit or receive the additional data to or from the host 110 through the auxiliary bus BUS_AUX, and transmit the HPD signal to the host 110 through the HPD bus BUS_HPD. The first TED TED0 and the second TED TED1 may transmit or receive the HPD signal to or from each other through the HPD bus BUS_HPD.

Figure 2:
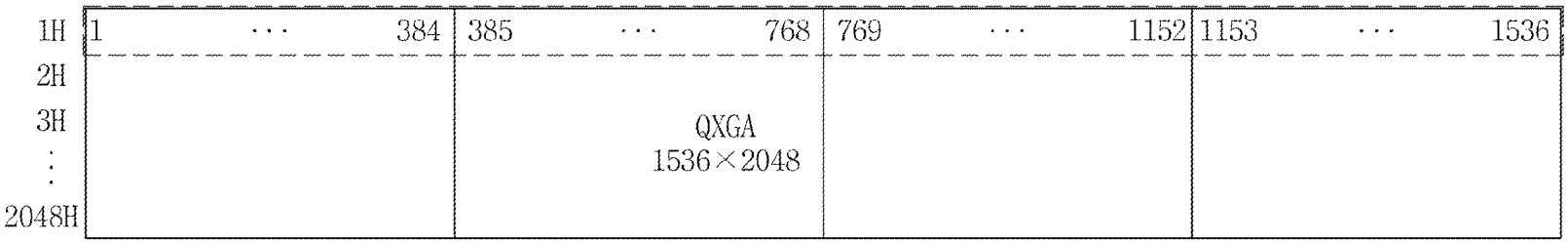
FIG. 2 is a block diagram illustrating an example of a display panel included in the display device of FIG. 1.

FIG. 2 is a block diagram illustrating an example of a display panel included in the display device of FIG. 1.

In FIG. 2, a display panel of a display device with QXGA grade having a resolution of 1536*2048 is shown. The display panel has 2048 rows and 1536 columns, and the first row may include pixels from 1 to 1536.

Figure 3:
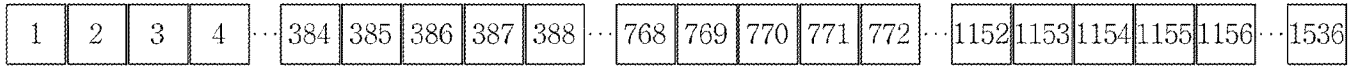
FIGS. 3 to 5 are diagrams illustrating data mapping methods when four main links are included in one port in the display device of FIG. 1.
Figure 4:
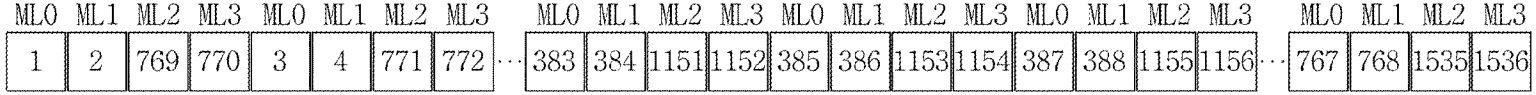
Figure 5:
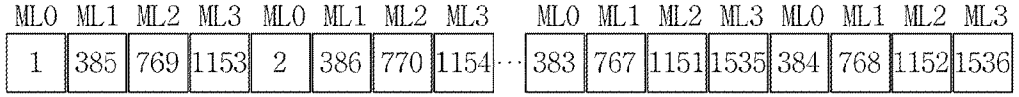

FIGS. 3 to 5 are diagrams illustrating data mapping methods when four main links are included in one port in the display device of FIG. 1. In FIGS. 3 to 5, data mapping for pixels in the first row is shown.

FIG. 3 illustrates data mapping that may be applied when the panel driving circuit 120 includes one TED, FIG. 4 illustrates data mapping that may be applied when the panel driving circuit 120 includes one or two TEDs, and FIG. 5 illustrates data mapping that may be applied when the panel driving circuit 120 includes one, two or four TEDs.

Referring to FIG. 3, in a first data mapping Mapping1, the lanes ML0, ML1, ML2 and ML3 of the main link ML may be mapped in order with pixels. For example, in the first data mapping Mapping1, the lanes ML0, ML1, ML2, ML3, ML0, ML1, ML2 and ML3 may correspond to pixels 1, 2, 3, 4, 5, 6, 7 and 8.

Referring to FIG. 4, in a second data mapping Mapping2, the lanes ML0 and ML1 among the lanes ML0, ML1, ML2 and ML3 of the main link ML may be mapped with pixels in a left half of a display panel, and the lanes ML2 and ML3 among the lanes ML0, ML1, ML2 and ML3 of the main link ML may be mapped with pixels in the right half of the display panel. For example, in the second data mapping Mapping2, the lanes ML0, ML1, ML2, ML3, ML0, ML1, ML2 and ML3 may correspond to pixels 1, 2, 769, 770, 3, 4, 771 and 772.

Referring to FIG. 5, in a third data mapping Mapping3, each of the lanes ML0, ML1, ML2 and ML3 of the main link ML may be mapped with pixels in a quarter of a row of a display panel starting from the left end. For example, in the third data mapping Mapping3, the lanes ML0, ML1, ML2, ML3, ML0, ML1, ML2 and ML3 may correspond to pixels 1, 385, 769, 1153, 2, 386, 770 and 1154.

Figures 6A, 6B:
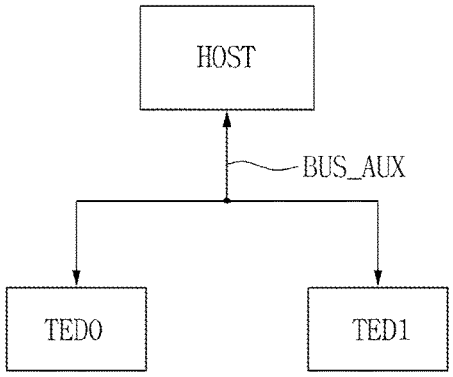
FIG. 6A is a block diagram illustrating an auxiliary bus that communicates using a multi-drop method among a host and timing controller embedded drivers (TEDs)
FIG. 6B is a table illustrating a method for selecting TEDs using addresses transmitted through the auxiliary bus in an auxiliary read mode or in an auxiliary write mode.

FIG. 6A is a block diagram illustrating an auxiliary bus that communicates using a multi-drop method among a host and TEDs, and FIG. 6B is a table illustrating a method for selecting TEDs using addresses transmitted through the auxiliary bus in an auxiliary read mode or in an auxiliary write mode.

Referring to FIG. 6A, the host HOST communicates with the TEDs TED0 and TED1 through the auxiliary bus BUS_AUX using a multi-drop method.

Referring to FIG. 6B, the host HOST may select one of the TEDs TED0 and TED1 for a read operation or write operation in response to addresses transmitted through the auxiliary bus BUS_AUX.

In at least one example embodiment, a first TED TED0 may be selected when the address transmitted through the auxiliary bus BUS_AUX is "10," and a second TED TED1 may be selected when the address transmitted through the auxiliary bus BUS_AUX is "11."

In at least one example embodiment, when the address transmitted through the auxiliary bus BUS_AUX is "OX," that is, "00" or "01," both of the first TED TED0 and the second TED TED1 may be selected, and the write operation or the read operation may not be performed but broadcasting of the write operation may be performed.

Figures 7A, 7B:
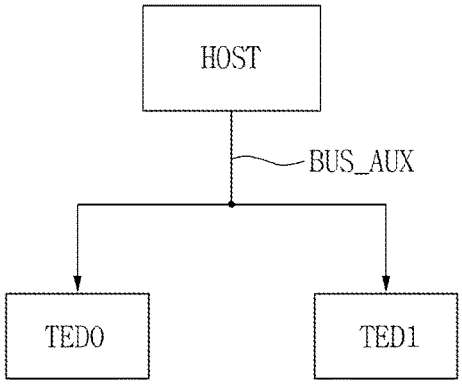
FIG. 7A is a block diagram illustrating a direction of data transmission through an auxiliary bus in an auxiliary write mode.
FIG. 7B is a diagram illustrating data formats for transmission data and reception data.

FIG. 7A is a block diagram illustrating a direction of data transmission through an auxiliary bus in an auxiliary write mode, and FIG. 7B is a diagram illustrating data formats for transmission data TX and reception data.

Referring to FIG. 7A, in an auxiliary write mode, data is transmitted from the host HOST to the first TED TED0 and the second TED TED1.

Referring to FIG. 7B, a data format of data transmitted from the host HOST may be the same as a data format of data received by the first TED TED0 and the second TED TED1. The data format may include a sync signal SYNC, a command COMM3:0, an address ADDR19:0, a line enable signal LEN7:0, data DATA and a stop signal STOP.

Figure 8A:
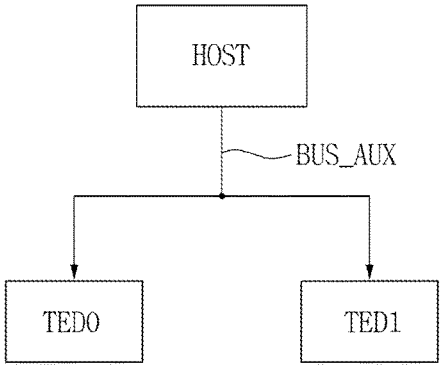
FIG. 8A is a block diagram illustrating a direction of read command transmission through an auxiliary bus in an auxiliary read mode.
Figure 8B:
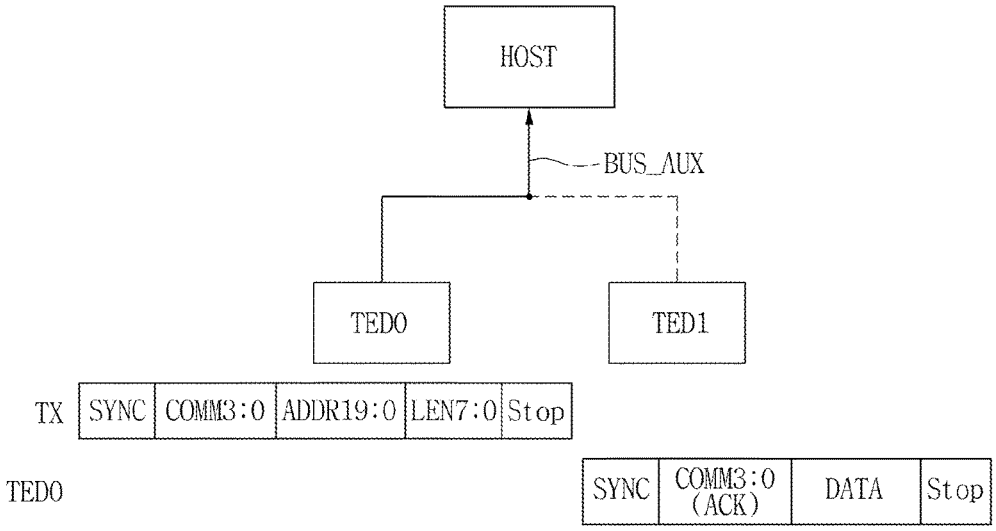
FIG. 8B is a diagram illustrating a direction of data transmission from a first TED to a host through an auxiliary bus and data formats.
Figure 8C:
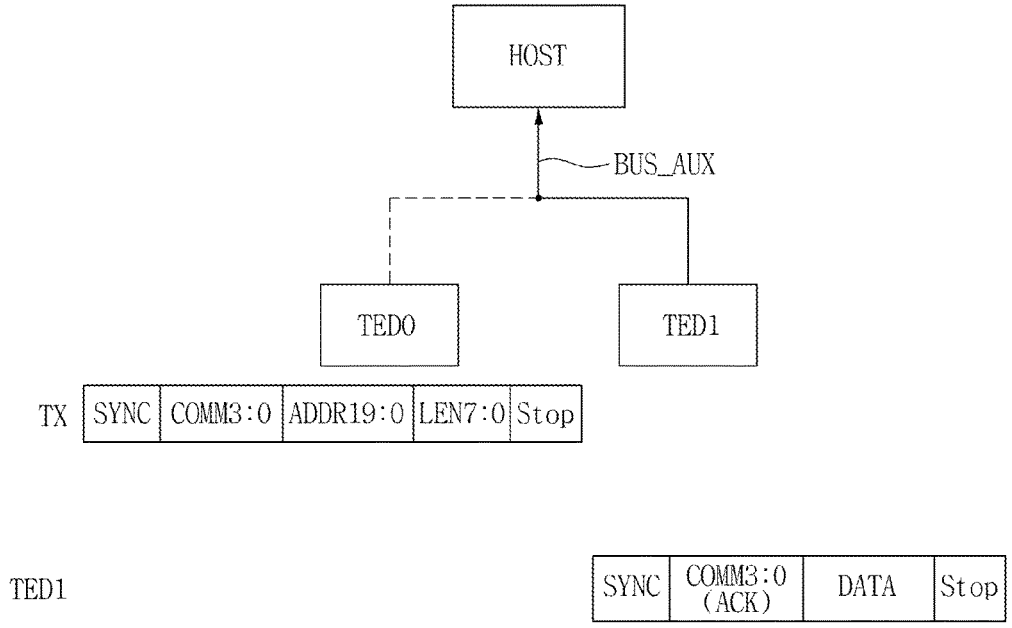
FIG. 8C is a diagram illustrating a direction of data transmission from a second TED to a host through an auxiliary bus and data formats.

FIG. 8A is a block diagram illustrating a direction of read command transmission through an auxiliary bus in an auxiliary read mode, FIG. 8B is a diagram illustrating a direction of data transmission from a first TED TED0 to a host through an auxiliary bus and data formats, and FIG. 8C is a diagram illustrating a direction of data transmission from a second TED TED1 to a host through an auxiliary bus and data formats.

Referring to FIG. 8A, in an auxiliary read mode, a read command is transmitted from the host HOST to the first TED TED0 and the second TED TED1. Referring to FIG. 8B, in an auxiliary read mode, data is transmitted from the first TED TED0 to the host HOST. In the auxiliary read mode, a format of the read command transmitted from the host HOST to the first TED TED0 may include a sync signal SYNC, a command COMM3:0, an address ADDR19:0, a line enable signal LEN7:0 and a stop signal STOP. In the auxiliary read mode, a data format transmitted from the first TED TED0 to the host HOST may include a sync signal SYNC, a command COMM3:0, data DATA and a stop signal STOP. Referring to FIG. 8C, in an auxiliary read mode, data is transmitted from the second TED TED1 to the host HOST. In the auxiliary read mode, a data format transmitted from the second TED TED1 to the host HOST may include a sync signal SYNC, a command COMM3:0, data DATA and a stop signal STOP.

The auxiliary bus BUS_AUX may be connected in a form of multi-drop structure among the host HOST and TEDs TED0 and TED1. Therefore, in the auxiliary read mode, the host HOST may transmit the read command only one time.

Figure 9A:
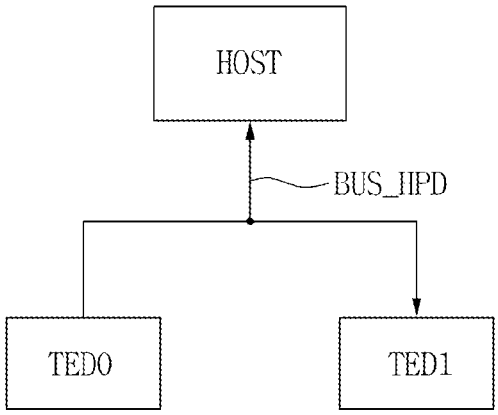
FIGS. 9A and 9B are block diagrams illustrating hot plug detect (HPD) buses through which an HPD signal is transmitted.
Figure 9B:
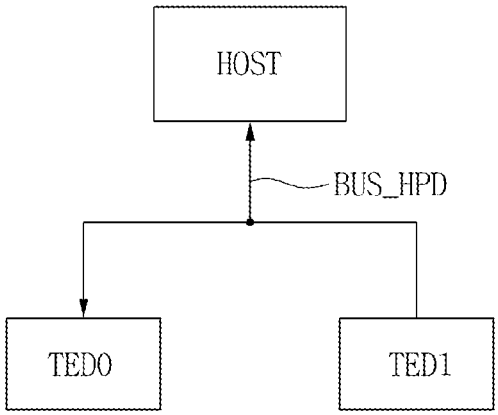

FIGS. 9A and 9B are block diagrams illustrating HPD buses through which an HPD signal is transmitted.

Referring to FIG. 9A, an HPD signal may be transmitted from the first TED TED0 to the host HOST through the HPD bus BUS_HPD. Further, the HPD signal may be transmitted from the first TED TED0 to the second TED TED1 through the HPD bus BUS_HPD. Referring to FIG. 9B, the HPD signal may be transmitted from the second TED TED1 to the host HOST through the HPD bus BUS_HPD. Further, the HPD signal may be transmitted from the second TED TED1 to the first TED TED0 through the HPD bus BUS_HPD.

FIGS. 10A to 10D are circuit diagrams illustrating structures of HPD buses through which an HPD signal is transmitted. As shown in FIGS. 10A to 10D, the HPD bus BUS_HPD may have connection structure of a wired logic.

Figure 10A:
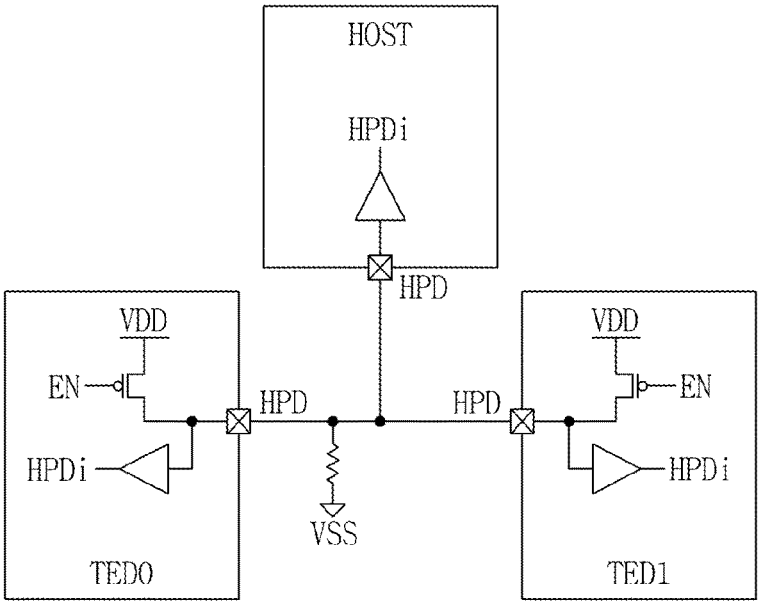
FIGS. 10A to 10D are circuit diagrams illustrating structures of HPD buses through which an HPD signal is transmitted.
Figure 10B:
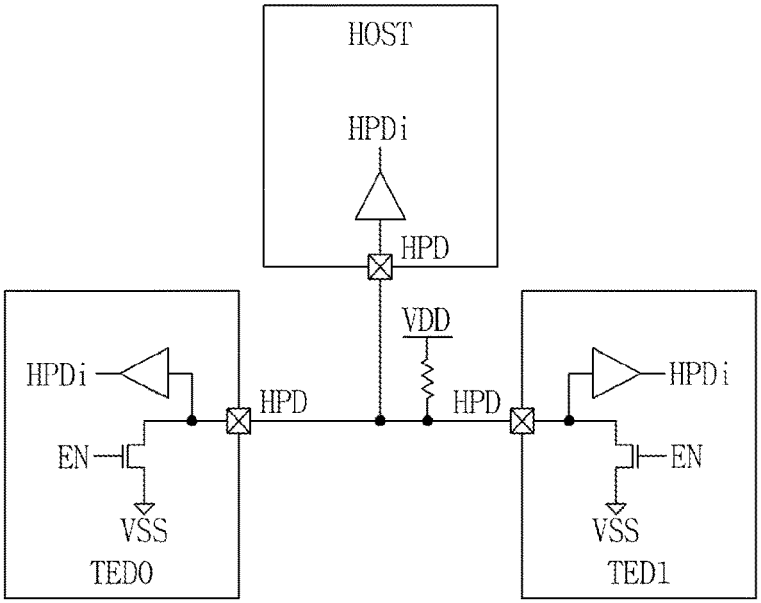
Figure 10C:
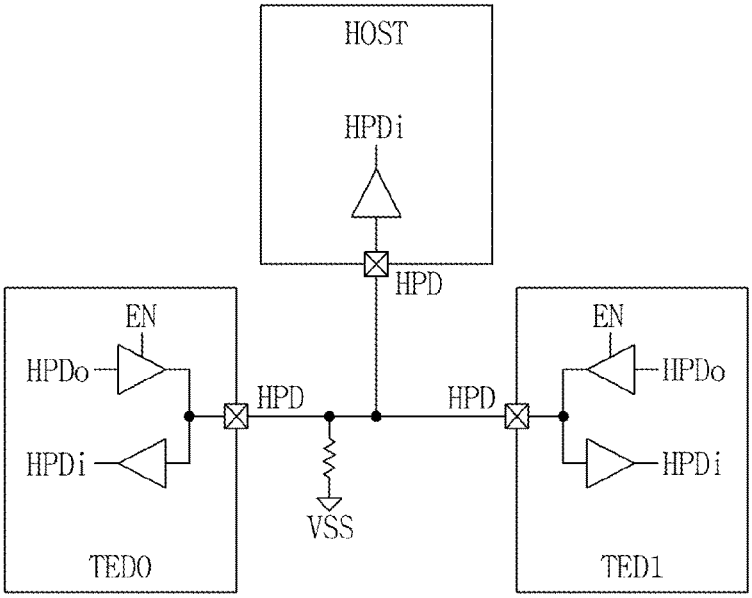
Figure 10D:
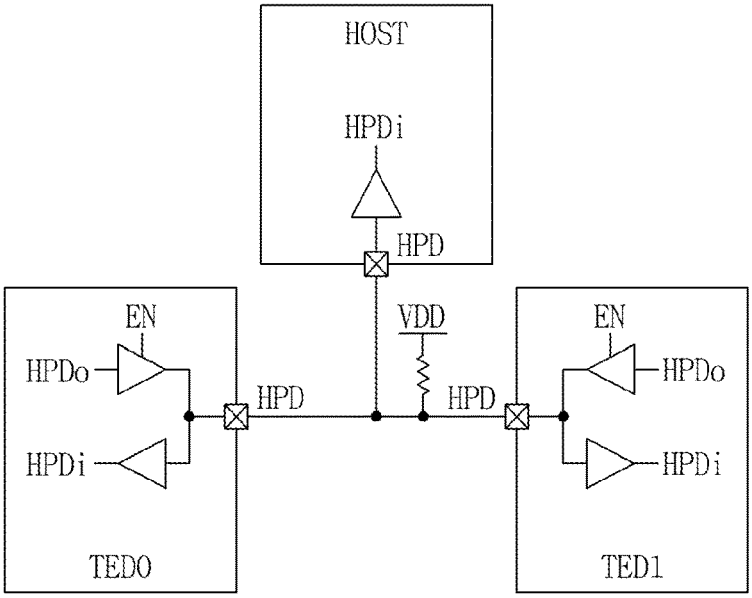

FIG. 10A is a diagram illustrating an example of an HPD bus that performs a high active operation, and FIG. 10B is a diagram illustrating an example of an HPD bus that performs a low active operation. FIG. 10C is a diagram illustrating another example of an HPD bus that performs a high active operation, and FIG. 10D is a diagram illustrating another example of an HPD bus that performs a low active operation.

Referring to FIG. 10A, the host HOST, the first TED TED0 and the second TED TED1 have their respective HPD pads, and a connection point of the HPD pads may be connected to the ground voltage VSS through a resistor. The host HOST is connected to an HPD pad included in the host HOST, and may include a buffer that generates HPDi. The first TED TED0 is connected to an HPD pad included in the first TED TED0, and may include a buffer that generates HPDi and a PMOS transistor connected between the buffer and a supply voltage VDD and controlled by an enable signal EN. The second TED TED1 is connected to an HPD pad included in the second TED TED1, and may include a buffer that generates HPDi and a PMOS transistor connected between the buffer and the supply voltage VDD and controlled by the enable signal EN.

Referring to FIG. 10B, the host HOST, the first TED TED0 and the second TED TED1 have their respective HPD pads, and a connection point of the HPD pads may be connected to the supply voltage VDD through a resistor. The host HOST is connected to an HPD pad included in the host HOST, and may include a buffer that generates HPDi. The first TED TED0 is connected to an HPD pad included in the first TED TED0, and may include a buffer that generates HPDi and an NMOS transistor connected between the buffer and a ground voltage VSS and controlled by an enable signal EN. The second TED TED1 is connected to an HPD pad included in the second TED TED1, and may include a buffer that generates HPDi and an NMOS transistor connected between the buffer and the ground voltage VSS and controlled by the enable signal EN.

Referring to FIG. 10C, the host HOST, the first TED TED0 and the second TED TED1 have their respective HPD pads, and a connection point of the HPD pads may be connected to the ground voltage VSS through a resistor. The host HOST is connected to an HPD pad included in the host HOST, and may include a buffer that generates HPDi. The first TED TED0 is connected to an HPD pad included in the first TED TED0, and may include a first buffer that generates HPDi and a second buffer that transmits HPDo to the HPD pad and controlled by an enable signal EN. The second TED TED1 is connected to an HPD pad included in the second TED TED1, and may include a third buffer that generates HPDi and a fourth buffer that transmits HPDo to the HPD pad and controlled by the enable signal EN.

Referring to FIG. 10D, the host HOST, the first TED TED0 and the second TED TED1 have their respective HPD pads, and a connection point of the HPD pads may be connected to the supply voltage VDD through a resistor. The host HOST is connected to an HPD pad included in the host HOST, and may include a buffer that generates HPDi. The first TED TED0 is connected to an HPD pad included in the first TED TED0, and may include a fifth buffer that generates HPDi and a sixth buffer that transmits HPDo to the HPD pad and is controlled by an enable signal EN. The second TED TED1 is connected to an HPD pad included in the second TED TED1, and may include a seventh buffer that generates HPDi and an eighth buffer that transmits HPDo to the HPD pad and is controlled by the enable signal EN.

Figure 11:
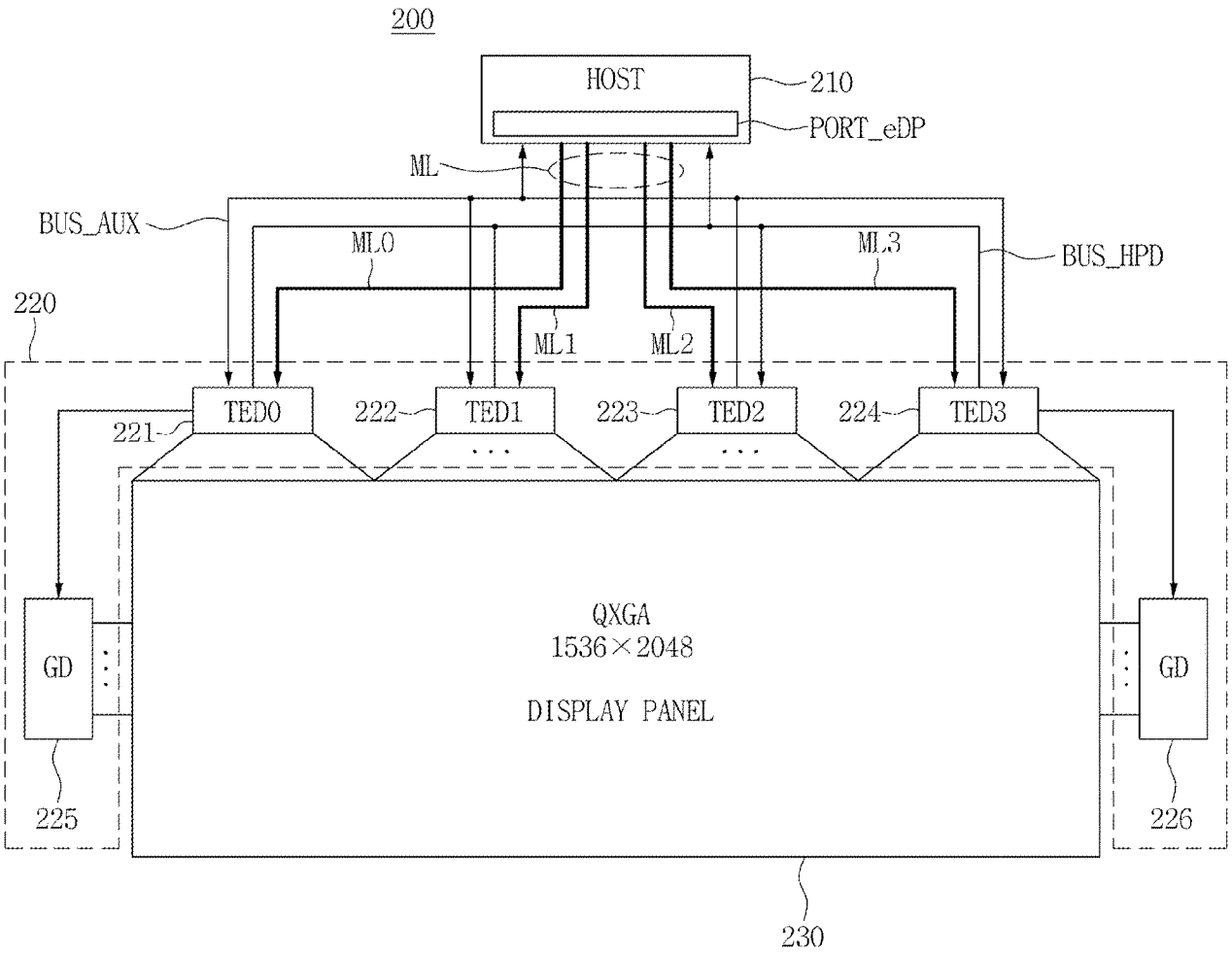
FIG. 11 is a block diagram illustrating a display device according to at least one example embodiment of inventive concepts.

FIG. 11 is a block diagram illustrating a display device 200 according to at least one example embodiment of inventive concepts.

Referring to FIG. 11, the display device 200 may include a host 210, a panel driving circuit 220 and a display panel 230.

The panel driving circuit 220 includes TEDs TED0 (221), TED1 (222), TED2 (223) and TED3 (224), and drives the display panel 230. The panel driving circuit 220 may further include gate drivers 225 and 226 that control the display panel 230 in response to control signals including a gate-start pulse. The host 210 transmits or receives video data, additional data, and an HPD signal to or from the TEDs TED0, TED1, TED2 and TED3 through one port PORT_eDP using a clock-embedded host interface. The host 210 may be an SOC.

The host 210 may transmit the video data to the TEDs TED0, TED1, TED2 and TED3 through a port PORT_eDP, transmit or receive the additional data to or from the TEDs TED0, TED1, TED2 and TED3 through the port PORT_eDP, and receive the HPD signal from the TEDs TED0, TED1, TED2 and TED3 through the port PORT_eDP. Each of the TEDs TED0, TED1, TED2 and TED3 may receive the video data from the host 210, transmit or receive the additional data to or from the host 210, transmit the HPD signal to the host 210, and transmit or receive the HPD signal to or from the other TEDs TED0, TED1, TED2 and TED3.

The host 210 may transmit the video data to the TEDs TED0, TED1, TED2 and TED3 through a main link ML that includes a plurality of lanes ML0, ML1, ML2 and ML3, transmit or receive the additional data to or from the TEDs TED0, TED1, TED2 and TED3 through an auxiliary bus BUS_AUX, and receive the HPD signal from the TEDs TED0, TED1, TED2 and TED3 through an HPD bus BUS_HPD.

The panel driving circuit 220 may include a first TED TED0, a second TED TED1, a third TED TED2 and a fourth TED TED3. The first TED TED0 receives the video data through a first lane ML0 of the main link ML, and drives an area of a first quarter of the display panel 230. The second TED TED1 receives the video data through a second lane ML1 of the main link ML, and drives an area of a second quarter of the display panel 230. The third TED TED2 receives the video data through a third lane ML2 of the main link ML and drives an area of a third quarter of the display panel 230. The fourth TED TED3 receives the video data through a fourth lane ML3 of the main link ML, and drives an area of the fourth quarter of the display panel 230.

Each of the first TED TED0, the second TED TED1, the third TED TED2 and the fourth TED TED3 may transmit or receive the additional data to or from the host through the auxiliary bus, and transmit the HPD signal to the host HOST through the HPD bus BUS_HPD. The first TED TED0, the second TED TED1, the third TED TED2 and the fourth TED TED3 may transmit or receive the HPD signal to or from each other through the HPD bus BUS_HPD.

FIG. 12 is a table illustrating a method for selecting TEDs using addresses transmitted through the auxiliary bus in an auxiliary read mode or in an auxiliary write mode in the display device of FIG. 11.

Referring to FIG. 12, the host HOST may select one of the TEDs TED0, TED1, TED2 and TED3 for a read operation or write operation in response to addresses transmitted through the auxiliary bus BUS_AUX.

In at least one example embodiment, a first TED TED0 may be selected when the address transmitted through the auxiliary bus BUS_AUX is "100," a second TED TED1 may be selected when the address transmitted through the auxiliary bus BUS_AUX is "101," a third TED TED2 may be selected when the address transmitted through the auxiliary bus BUS_AUX is "110," and a fourth TED TED3 may be selected when the address transmitted through the auxiliary bus BUS_AUX is "111."

In at least one example embodiment, when the address transmitted through the auxiliary bus BUS_AUX is "0XX," all of the first TED TED0, the second TED TED1, the third TED TED2 and the fourth TED TED3 may be selected, and the write operation or the read operation may not be performed but broadcasting of the write operation may be performed.

Figure 13:
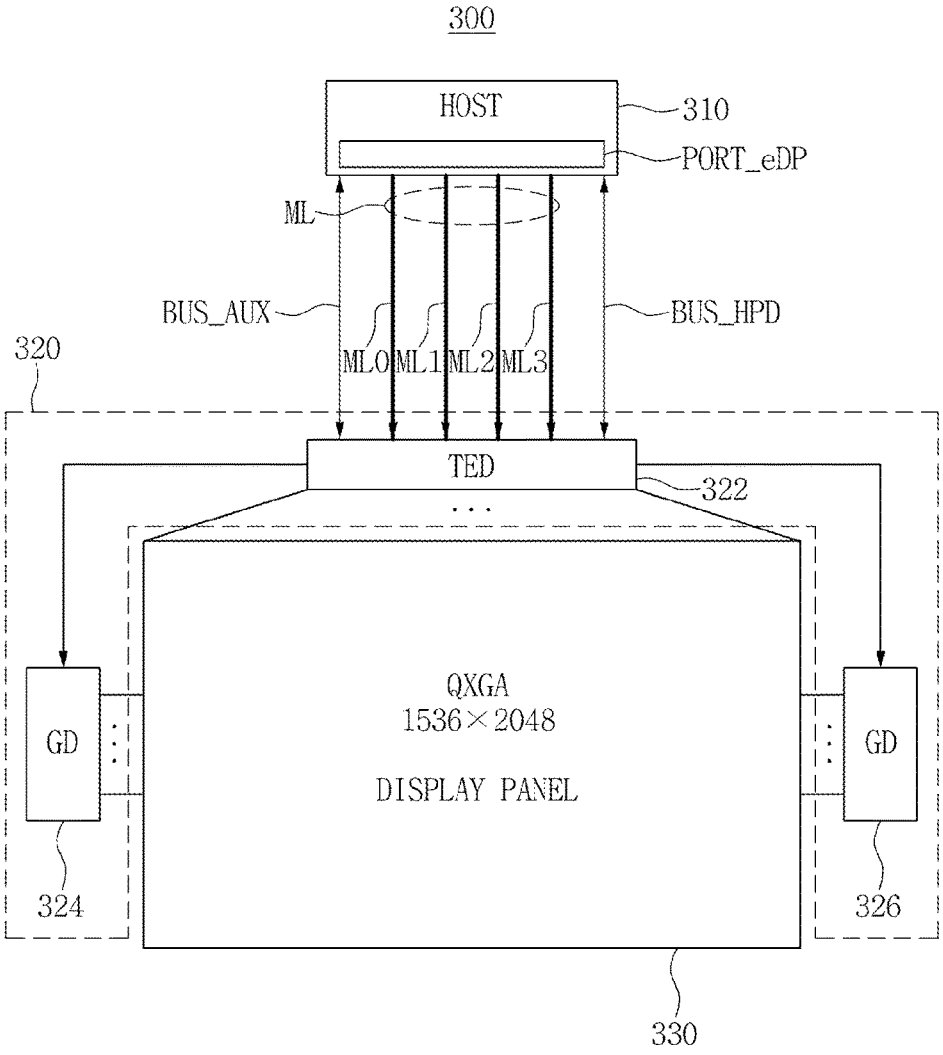
FIG. 13 is a block diagram illustrating a display device according to at least one example embodiment of inventive concepts.

FIG. 13 is a block diagram illustrating a display device 300 according to at least one example embodiment of inventive concepts.

Referring to FIG. 13, the display device 300 may include a host 310, a panel driving circuit 320 and a display panel 330.

The panel driving circuit 320 includes a TED 322 and drives the display panel 330. The panel driving circuit 320 may further include gate drivers 324 and 326 that control the display panel 330 in response to control signals including a gate-start pulse. The host 310 transmits or receives video data, additional data, and an HPD signal to or from the TED 322 through one port PORT_eDP using a clock-embedded host interface. The host 310 may be an SOC.

The host 310 may transmit the video data to the TED 322 through a main link ML that includes a plurality of lanes ML0, ML1, ML2 and ML3, transmit or receive the additional data to or from the TED 322 through an auxiliary bus BUS_AUX, and receive the HPD signal from the TED 322 through an HPD bus BUS_HPD.

Figure 14:
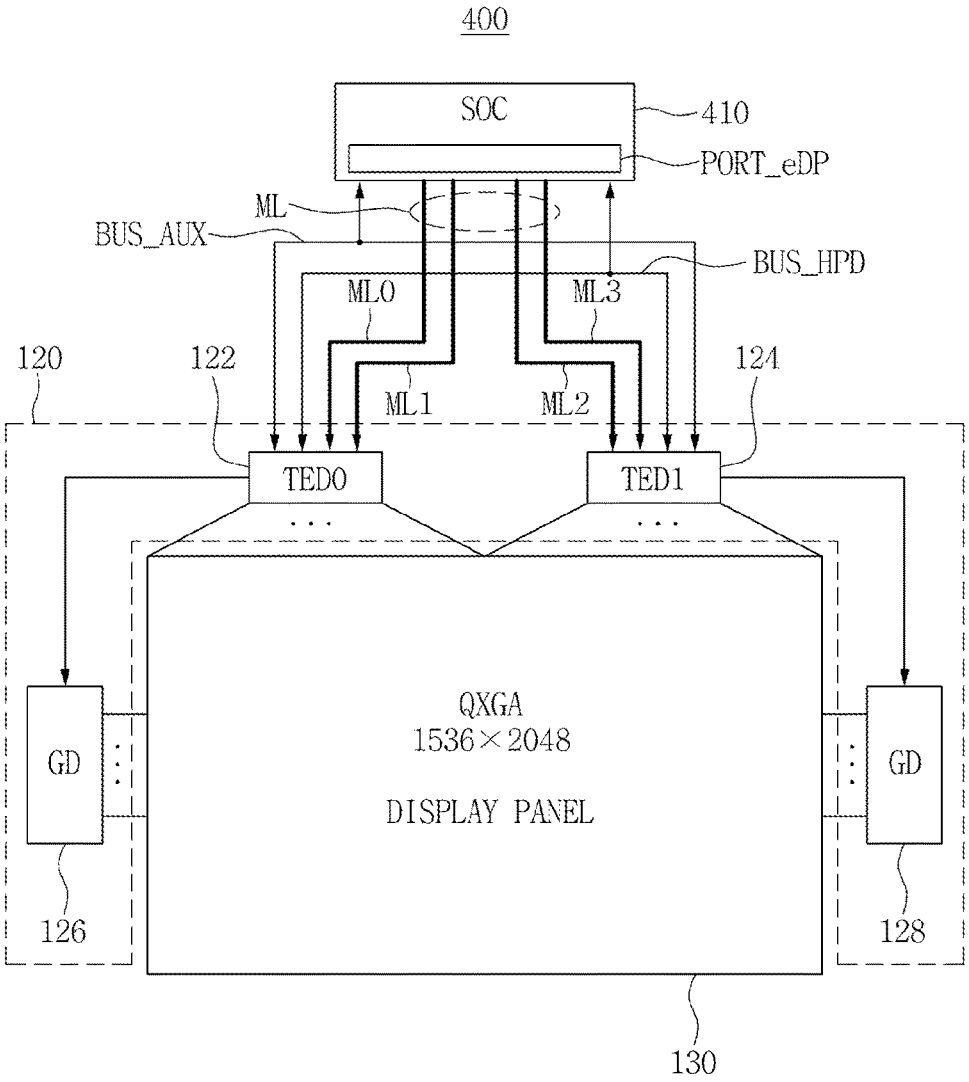
FIG. 14 is a block diagram illustrating a display device according to at least one example embodiment of inventive concepts.

FIG. 14 is a block diagram illustrating a display device 400 according to at least one example embodiment of inventive concepts.

Referring to FIG. 14, the display device 400 may include an SOC 410, a panel driving circuit 120 and a display panel 130. In the display device 400 of FIG. 14, the SOC 410 functions as the host 110 included in the display device 100 of FIG. 1.

Figure 15:
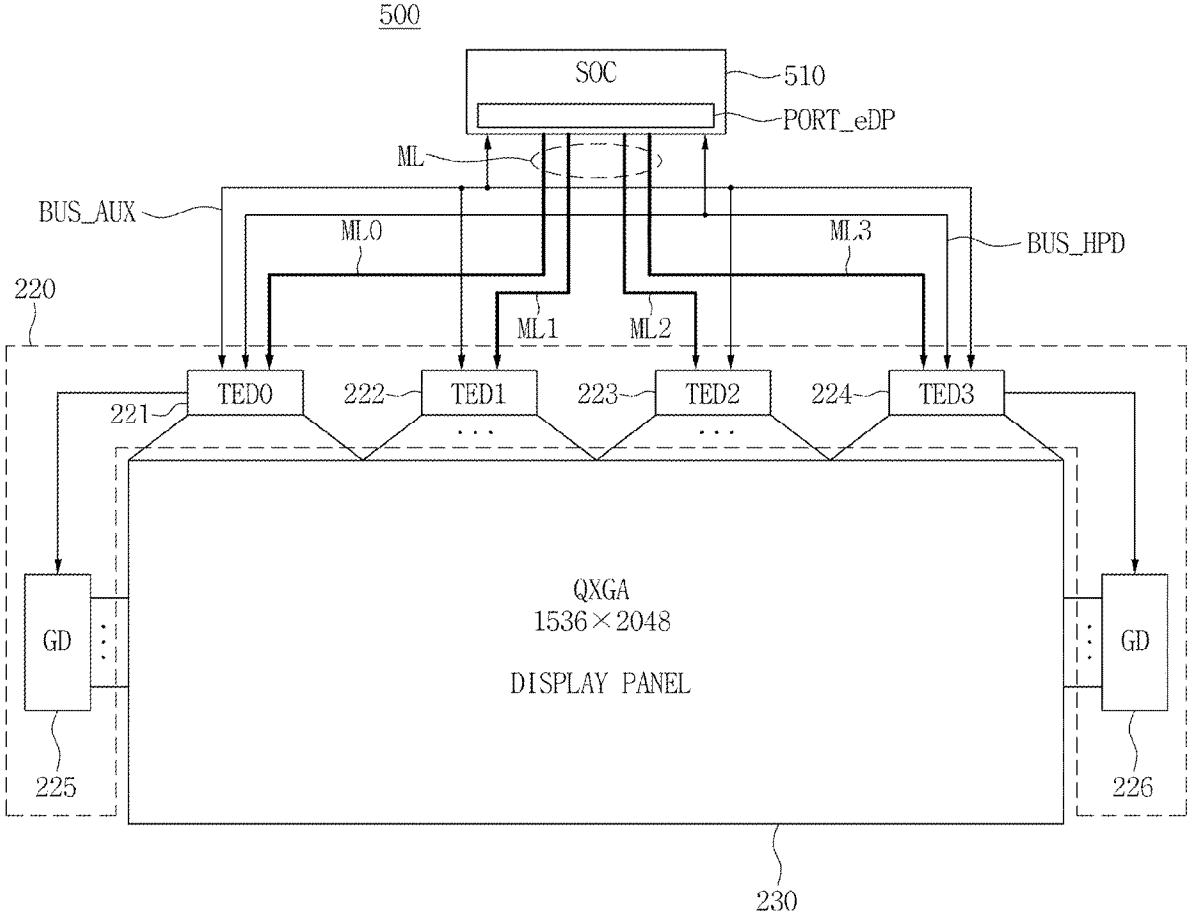
FIG. 15 is a block diagram illustrating a display device according to at least one example embodiment of inventive concepts.

FIG. 15 is a block diagram illustrating a display device 500 according to at least one example embodiment of inventive concepts.

Referring to FIG. 15, the display device 500 may include an SOC 510, a panel driving circuit 220 and a display panel 230. In the display device 500 of FIG. 15, the SOC 510 functions as the host 210 included in the display device 20 of FIG. 11.

In FIGS. 1, 11, 13, 14 and 15, gate drivers GD receive control signals from TEDs. However, the gate drivers GD may receive the control signals from the external.

Figure 16:
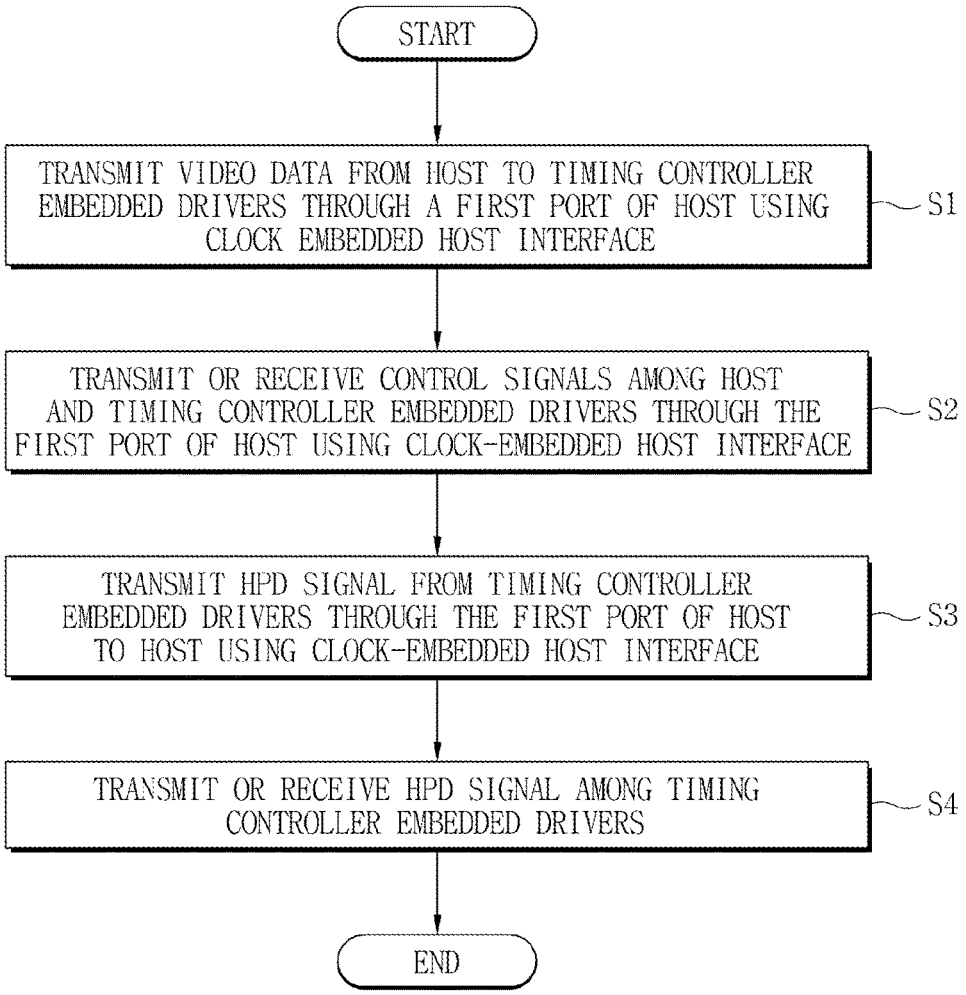
FIG. 16 is a flowchart illustrating a method of operating a display device according to at least one example embodiment of inventive concepts.

FIG. 16 is a flowchart illustrating a method of operating a display device that includes a host and TEDs according to at least one example embodiment of inventive concepts.

Referring to FIG. 16, the method of operating a display device according to at least one example embodiment of inventive concepts may include the following operations:

(1) transmitting video data from the host to the TEDs through a first port of the host using a clock-embedded host interface (S1).

(2) transmitting or receiving control signals among the host and the TEDs through the first port of the host using a clock-embedded host interface (S2), (3) transmitting the HPD signal from the TEDs through the first port of the host to the host using a clock-embedded host interface (S3), and (4) transmitting or receiving the HPD signal among the TEDs (S4).

According to at least one example embodiment, the video data is transmitted to the TEDs through a main link that includes a plurality of lanes.

According to at least one example embodiment, additional data including the control signals is transmitted or received between the host and TEDs through an auxiliary bus.

According to at least one example embodiment, the HPD signal is transmitted from the TEDs to the host through an HPD bus.

According to at least one example embodiment, the operation of transmitting the video data from the host to the TEDs through a first port of the host using a clock-embedded host interface (S1) and the operation of transmitting or receiving the control signals among the host and the TEDs through the first port of the host using a clock-embedded host interface (S2) may be performed independently from each other.

According to at least one example embodiment, the operation of transmitting the HPD signal from the TEDs through the first port of the host to the host using a clock-embedded host interface (S3) and the operation of transmitting or receiving the HPD signal among the TEDs (S4) may be performed at the same time.

Figure 17:
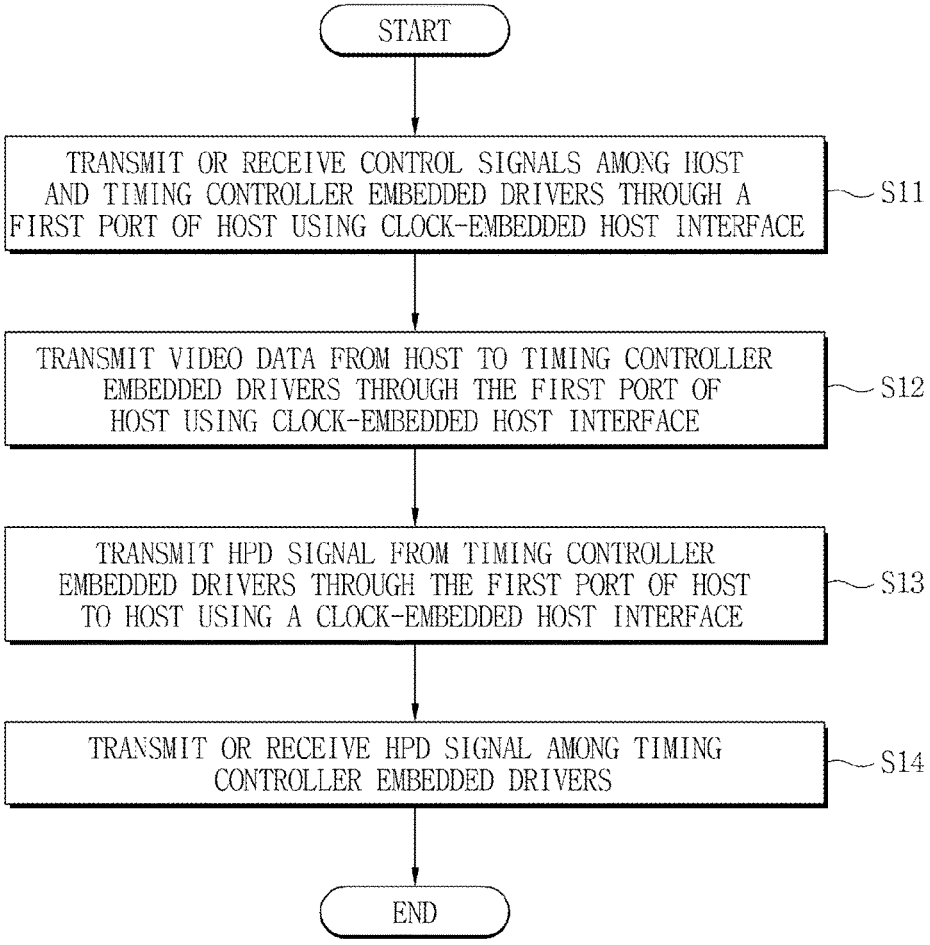
FIG. 17 is a flowchart illustrating a method of operating a display device according to at least one example embodiment of inventive concepts.

FIG. 17 is a flowchart illustrating a method of operating a display device that includes a host and TEDs according to at least one example embodiment of inventive concepts.

Referring to FIG. 17, the method of operating a display device according to at least one example embodiment of inventive concepts may include the following operations:

(1) transmitting or receiving control signals among the host and the TEDs through the first port of the host using a clock-embedded host interface (S11), (2) transmitting video data from the host to the TEDs through a first port of the host using a clock-embedded host interface (S12), (3) transmitting the HPD signal from the TEDs through the first port of the host to the host using a clock-embedded host interface (S13), and (4) transmitting or receiving the HPD signal among the TEDs (S14).

In the method of operating a display device as shown in FIG. 17, the operation of transmitting the video data from the host to the TEDs through a first port of the host using a clock-embedded host interface (S12) may be performed after the operation of transmitting or receiving the control signals among the host and the TEDs through the first port of the host using a clock-embedded host interface (S11) is performed.

According to at least one example embodiment, the operation of transmitting or receiving the control signals among the host and the TEDs through the first port of the host using a clock-embedded host interface (S11) and the operation of transmitting the video data from the host to the TEDs through a first port of the host using a clock-embedded host interface (S12) may be performed independently from each other.

According to at least one example embodiment, the operation of transmitting the HPD signal from the TEDs through the first port of the host to the host using a clock-embedded host interface (S13) and the operation of transmitting or receiving the HPD signal among the TEDs (S14) may be performed at the same time.

Figure 18:
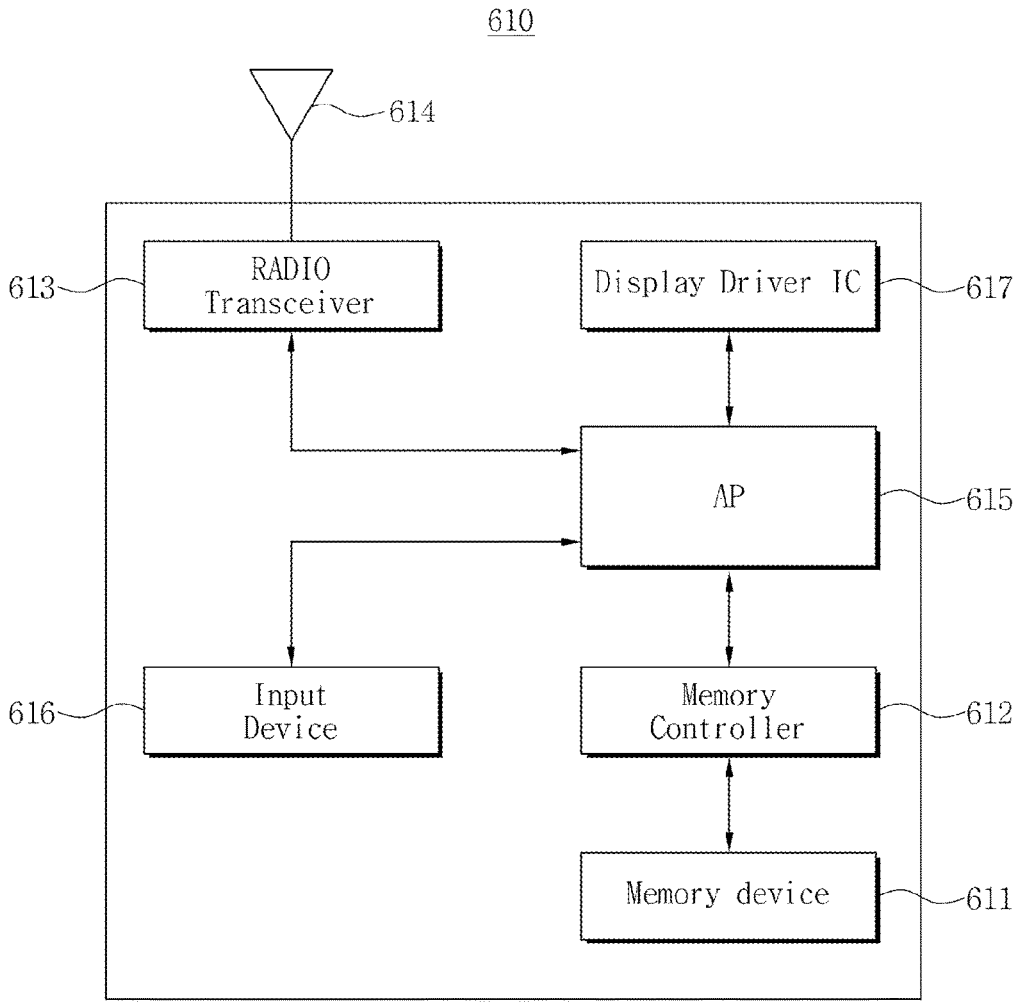
FIGS. 18 to 20 are block diagrams illustrating computer systems including a display device shown in FIG. 1, 11 or 13 according to at least one example embodiment of inventive concepts.
Figure 19:
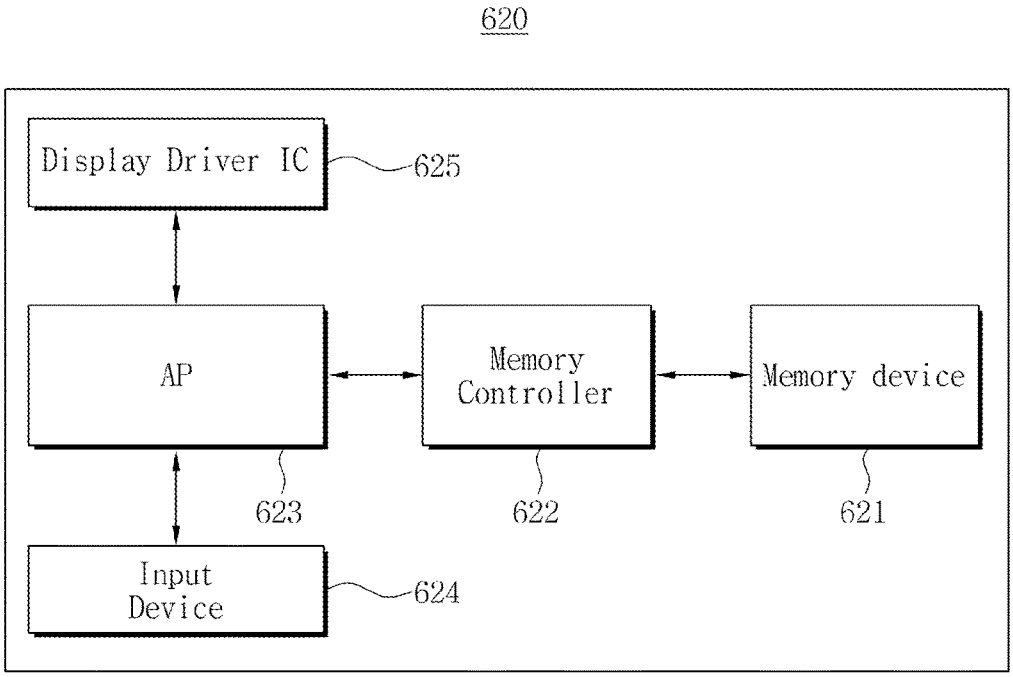
Figure 20:
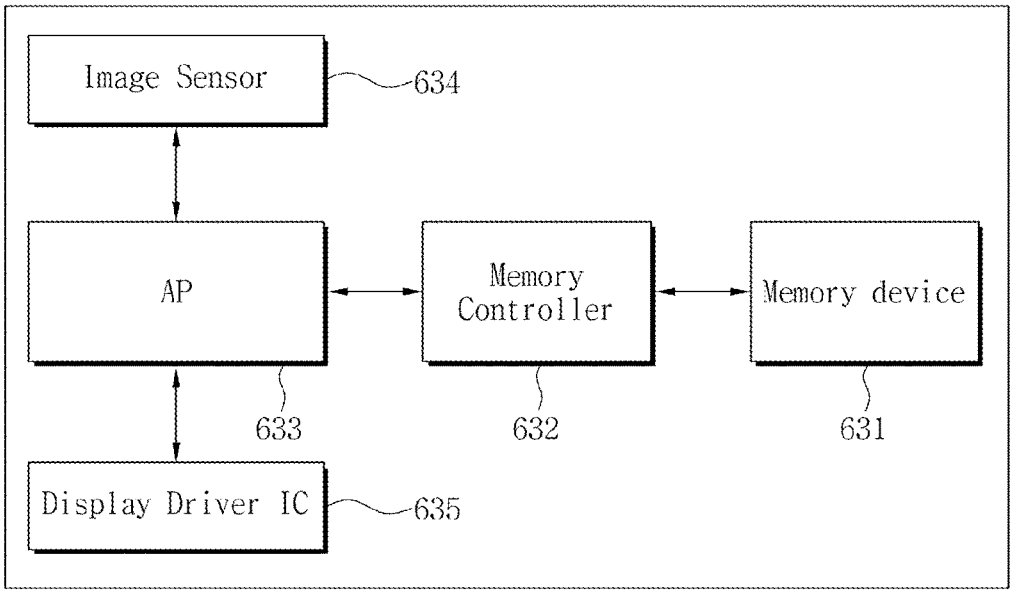

FIGS. 18 to 20 are block diagrams illustrating computer systems including a display device shown in FIG. 1, 11 or 13 according to at least one example embodiment of inventive concepts.

Referring to FIG. 18, the computer system 610 includes a memory device 611, a memory controller 612 configured to control the memory device 611, a radio transceiver 613, an antenna 614, an application processor (AP) 615, an input device 616, and a DDI 617.

The radio transceiver 613 may transmit or receive radio signals through the antenna 614. For example, the radio transceiver 613 may convert a radio signal received through the antenna 614 into a signal which may be processed in the AP 615.

Therefore, the AP 615 may process a signal output from the radio transceiver 613, and transmit a processed signal to the DDI 617. Further, the radio transceiver 613 may convert a signal output from the AP 615 into a radio signal, and output the converted radio signal to an external device through the antenna 614.

As the input device 616 is a device in which a control signal for controlling an operation of the AP 615, or data to be processed by the AP 615 may be input, the input device 616 may be implemented as a pointing device, such as a touch pad or a computer mouse, a keypad, or a keyboard.

According to at least one example embodiment, the memory controller 612 configured to control an operation of the memory device 611 may be implemented as a part of the AP 615, or as a chip separated from the AP 615.

According to at least one example embodiment, the DDI 617 may correspond to the panel driving circuit of the display device shown in FIG. 1, FIG. 11 or FIG. 13, and the AP 615 may correspond to the host of the display device shown in FIG. 1, FIG. 11 or FIG. 13. Therefore, the AP 615 may transmit or receive video data, additional data, and an HPD signal to or from the TEDs included in the panel driving circuit through one port using a clock-embedded host interface. Therefore, the number of interface pins between the AP 615 and the TEDs may be decreased, and the power consumption of the computer system 610 may be reduced.

Referring to FIG. 19, the computer system 620 may be implemented as a personal computer (PC), a network server, a tablet PC, a net-book, an e-reader, a personal digital assistant (PDA), a portable multimedia player (PMP), an MP3 player, or an MP4 player.

The computer system 620 may include a memory device 621, a memory controller 622 configured to control a data processing operation of the memory device 621, an AP 623, an input device 624, and a DDI 625.

The AP 623 may display data stored in the memory device 621 through the DDI 625 according to data input through the input device 624. For example, the input device 624 may be implemented as a pointing device, such as a touch pad or a computer mouse, a keypad, or a keyboard. The AP 623 may control overall operations of the computer system 620, and control an operation of the memory controller 622.

According to at least one example embodiment, the memory controller 622 configured to control the operation of the memory device 621 may be implemented as a part of the AP 623, or as a chip separated from the AP 623.

According to at least one example embodiment, the DDI 625 may correspond to the panel driving circuit of the display device shown in FIG. 1, FIG. 11 or FIG. 13, and the AP 625 may correspond to the host of the display device shown in FIG. 1, FIG. 11 or FIG. 13. Therefore, the AP 625 may transmit or receive video data, additional data, and an HPD signal to or from the TEDs included in the panel driving circuit through one port using a clock-embedded host interface. Therefore, the number of interface pins between the AP 625 and the TEDs may be decreased, and the power consumption of the computer system 620 may be reduced.

Referring to FIG. 20, the computer system 630 may be implemented as an image processing device, for example, a digital camera, or a mobile phone, a smart phone, or a tablet in which a digital camera is mounted.

The computer system 630 includes a memory device 631, a memory controller 632 configured to control a data process operation, for example, a write operation or a read operation of the memory device 631. Further, the computer system 630 includes an AP 633, an image sensor 634, and a DDI 635.

The image sensor 634 of the computer system 630 converts an optical image to digital signals, and the converted digital signals are transmitted to the AP 633 or the memory controller 632. The converted digital signals may be displayed on the DDI 635, or may be stored in the memory device 631 through the memory controller 632, according to a control of the AP 633.

Further, data stored in the memory device 631 is displayed on the DDI 635 according to a control of the AP 633 or the memory controller 632.

According to at least one example embodiment, the memory controller 632 configured to control an operation of the memory device 631 may be implemented as a part of the AP 633, or as a chip separated from the AP 633.

According to at least one example embodiment, the DDI 635 may correspond to the panel driving circuit of the display device shown in FIG. 1, FIG. 11 or FIG. 13, and the AP 633 may correspond to the host of the display device shown in FIG. 1, FIG. 11 or FIG. 13. Therefore, the AP 633 may transmit or receive video data, additional data, and an HPD signal to or from the TEDs included in the panel driving circuit through one port using a clock-embedded host interface. Therefore, the number of interface pins between the AP 633 and the TEDs may be decreased, and the power consumption of the computer system 630 may be reduced.

The display driver according to at least one example embodiment of inventive concepts may include a host and TEDs. The host may transmit or receive video data, additional data, and an HPD signal to or from the TEDs included in the panel driving circuit through one port using a clock-embedded host interface. Therefore, the number of interface pins between the host and the TEDs may be decreased, and the power consumption of the computer system 630 may be reduced. Therefore, the display device according to at least one example embodiment of inventive concepts may be applied to a high resolution display device.

Example embodiments of inventive concepts may be applied to a display device and a computer system including the display device.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages. Accordingly, all such modifications are intended to be included within the scope of inventive concepts as defined in the claims. In the claims, means-plus-function clauses are intended to cover the structures described herein as performing the recited function, and not only structural equivalents but also equivalent structures.

What is claimed is:

1. A display device, comprising:

a panel driving circuit including a plurality of timing controller embedded drivers (TEDs), the panel driving circuit being configured to drive a display panel; and a host configured to, transmit video data to at least one TED of the plurality of TEDs through one port using a clock-embedded host interface, transmit or receive additional data, including an address for a write operation or a read operation, to or from the at least one TED through the one port using the clock-embedded host interface, and receive a hot plug detection (HPD) signal from the at least one TED through the one port using the clock-embedded host interface, wherein the host is configured to transmit the video data to the at least one TED through a main link including a plurality of lanes associated with the plurality of TEDs, each TED of the plurality of TEDs being associated with at least one corresponding lane of the plurality of lanes, the host being configured to transmit the video data through the plurality of lanes such that each TED of the plurality of TEDs drives a different portion of the display panel according to a data mapping in which the plurality of lanes are mapped to corresponding pixels of the display panel; and wherein the at least one TED includes a first TED and a second TED, and the host is configured to select the first TED, the second TED, or both of the first TED and the second TED based on the address for the write operation or the read operation.

2. The display device of claim 1, wherein the at least one TED is configured to, receive the video data from the host, transmit or receive the additional data to or from the host, transmit the HPD signal to the host, and transmit or receive the HPD signal to or from other TEDs of the plurality of TEDs.

3. The display device of claim 1, wherein the host is configured to, transmit or receive the additional data, including the address for the write operation or the read operation, to or from the at least one TED through an auxiliary bus, and receive the HPD signal from the at least one TED through an HPD bus.

4. The display device of claim 3, wherein:

the plurality of lanes includes a first lane, a second lane, a third lane, and a fourth lane, the first TED is configured to receive the video data through the first lane and the second lane, and to drive an area of a first half of the display panel, according to the data mapping, and the second TED is configured to receive the video data through the third lane and the fourth lane, and to drive an area of a second half of the display panel, according to the data mapping.

5. The display device of claim 4, wherein each of the first TED and the second TED is configured to, transmit or receive the additional data, including the address for the write operation or the read operation, to or from the host through the auxiliary bus, and transmit the HPD signal to the host through the HPD bus.

6. The display device of claim 4, wherein the first TED and the second TED are configured to transmit or receive the HPD signal to or from each other through the HPD bus.

7. The display device of claim 3, wherein the host is configured to select the first TED in response to the address transmitted or received through the auxiliary bus being "10," and select the second TED in response to the address transmitted or received through the auxiliary bus being "11."

8. The display device of claim 3, wherein the host is configured to select both of the first TED and the second TED in response to the address transmitted or received through the auxiliary bus being "00" or "01," and the write operation or the read operation is not performed but broadcasting of the write operation is performed.

9. The display device of claim 3, wherein the auxiliary bus is connected in a multi-drop structure among the host and the at least one TED.

10. A display device, comprising:

a panel driving circuit including a plurality of timing controller embedded drivers (TEDs), the panel driving circuit being configured to drive a display panel; and an application processor (AP) configured to, transmit video data to at least one TED of the plurality of TEDs through one port using a clock-embedded host interface, transmit or receive additional data, including an address for a write operation or a read operation, to or from the at least one TED through the one port using the clock-embedded host interface, and receive a hot plug detection (HPD) signal from the at least one TED through the one port using the clock-embedded host interface, wherein the AP is configured to transmit the video data to the at least one TED through a main link including a plurality of lanes associated with the plurality of TEDs, each TED of the plurality of TEDs being associated with at least one corresponding lane of the plurality of lanes, the AP being configured to transmit the video data through the plurality of lanes such that each TED of the plurality of TEDs drives a different portion of the display panel according to a data mapping in which the plurality of lanes are mapped to corresponding pixels of the display panel; and wherein the at least one TED includes a first TED, a second TED, a third TED, and a fourth TED, and the AP is configured to select the first TED, the second TED, the third TED, the fourth TED, or all of the first through fourth TEDs based on the address for the write operation or the read operation.

11. The display device of claim 10, wherein the AP is configured to, transmit or receive the additional data, including the address for the write operation or the read operation, to or from the at least one TED through an auxiliary bus, and receive the HPD signal from the at least one TED through an HPD bus.

12. The display device of claim 11, wherein:

the plurality of lanes includes a first lane, a second lane, a third lane, and a fourth lane, the first TED is configured to receive the video data through the first lane, and to drive an area of a first quarter of the display panel, according to the data mapping, the second TED is configured to receive the video data through the second lane, and to drive an area of a second quarter of the display panel, according to the data mapping, the third TED is configured to receive the video data through the third lane, and to drive an area of a third quarter of the display panel, according to the data mapping, and the fourth TED is configured to receive the video data through the fourth lane, and to drive an area of a fourth quarter of the display panel, according to the data mapping.

13. The display device of claim 12, wherein each of the first TED, the second TED, the third TED and the fourth TED is configured to, transmit or receive the additional data, including the address for the write operation or the read operation, to or from the AP through the auxiliary bus, and transmit the HPD signal to the AP through the HPD bus.

14. The display device of claim 11, wherein the AP is configured to, select the first TED in response to the address transmitted or received through the auxiliary bus being "100,"

select the second TED in response to the address transmitted or received through the auxiliary bus being "101,"

select the third TED in response to the address transmitted or received through the auxiliary bus being "110,"

select the fourth TED in response to the address transmitted or received through the auxiliary bus being "111," and select all of the first through fourth TEDs in response to the address transmitted or received through the auxiliary bus being "000," "001," "010," or "011," wherein the write operation or the read operation is not performed but broadcasting of the write operation is performed.

15. A display device, comprising:

a host configured to, transmit video data to at least one timing controller embedded driver (TED) of a plurality of TEDs through a single port using a clock-embedded host interface, the plurality of TEDs being configured to drive a display panel of the display device, transmit or receive additional data, including an address for a write operation or a read operation, to or from the at least one TED through the single port using the clock-embedded host interface, and receive a hot plug detection (HPD) signal from the at least one TED through the single port using the clock-embedded host interface, wherein the host is configured to transmit the video data to the at least one TED through a main link including a plurality of lanes associated with the plurality of TEDs, each TED of the plurality of TEDs being associated with at least one corresponding lane of the plurality of lanes, the host being configured to transmit the video data through the plurality of lanes such that each TED of the plurality of TEDs drives a different portion of the display panel according to a data mapping in which the plurality of lanes are mapped to corresponding pixels of the display panel; and wherein the plurality of TEDs includes at least a first TED and a second TED, and the host is configured to select the first TED, the second TED, or both of the first TED and the second TED based on the address for the write operation or the read operation.

16. The display device of claim 14, wherein the host is configured to transmit or receive the additional data, including the address for the write operation or the read operation, to or from the at least one TED through a first bus.

17. The display device of claim 16, wherein the host is configured to receive the HPD signal from the at least one TED through a second bus.

18. The display device of claim 16, wherein:

the plurality of lanes includes a first lane, a second lane, a third lane, and a fourth lane, the host is configured to, select the first TED in response to the address transmitted or received through the first bus being "10,"

select the second TED in response to the address transmitted or received through the first bus being "11," and select both of the first TED and the second TED in response to the address transmitted or received through the first bus being "00" or "01," wherein the write operation or the read operation is not performed but broadcasting of the write operation is performed, the first TED is configured to receive the video data through the first lane and the second lane, and to drive an area of a first half of the display panel, according to the data mapping, and the second TED is configured to receive the video data through the third lane and the fourth lane, and to drive an area of a second half of the display panel, according to the data mapping.

19. The display device of claim 16, wherein:

the plurality of lanes includes a first lane, a second lane, a third lane, and a fourth lane, the plurality of TEDs includes the first TED, the second TED, a third TED, and a fourth TED, the host is configured to, select the first TED in response to the address transmitted or received through the first bus being "100,"

select the second TED in response to the address transmitted or received through the first bus being "101,"

select the third TED in response to the address transmitted or received through the first bus being "110,"

select the fourth TED in response to the address transmitted or received through the first bus being "111," and select all of the first through fourth TEDs in response to the address transmitted or received through the first bus being "000," "001," "010," or "011," wherein the write operation or the read operation is not performed but broadcasting of the write operation is performed, the first TED is configured to receive the video data through the first lane, and to drive an area of a first quarter of the display panel, according to the data mapping, the second TED is configured to receive the video data through the second lane, and to drive an area of a second quarter of the display panel, according to the data mapping, the third TED is configured to receive the video data through the third lane, and to drive an area of a third quarter of the display panel, according to the data mapping, and the fourth TED is configured to receive the video data through the fourth lane, and to drive an area of a fourth quarter of the display panel, according to the data mapping.

* * * * *